United States Patent [19]

Young

[11] Patent Number: 5,056,241

[45] Date of Patent: Oct. 15, 1991

[54] SANDAL

[76] Inventor: Clifford K. Young, 244 N. Highway 101, Encinitas, Calif. 92024

[21] Appl. No.: 512,625

[22] Filed: Apr. 11, 1990

Related U.S. Application Data

[63] Continuation of Ser. No. 260,626, Oct. 21, 1988, abandoned.

[51] Int. Cl.[5] ..... A43B 3/12

[52] U.S. Cl. ..... 36/11.5

[58] Field of Search ..... 36/11.5, 7.5, 7.6, 7.8; 12/142 S; D 2/290

[56] References Cited

U.S. PATENT DOCUMENTS

| | | | |
|---|---|---|---|
| 1,213,030 | 1/1917 | Skinner | 36/11.5 |
| 2,090,675 | 8/1937 | Hadaway | 36/11.5 |
| 2,112,884 | 4/1938 | Gillette | 36/11.5 |
| 2,894,338 | 7/1959 | Scholl | 36/11.5 |

FOREIGN PATENT DOCUMENTS

| | | | |
|---|---|---|---|
| 151937 | 6/1953 | Australia | 36/11.5 |
| 152823 | 8/1953 | Australia | 36/11.5 |
| 760714 | 3/1934 | France | 36/11.5 |
| 1031332 | 6/1953 | France | 36/11.5 |
| 1136951 | 5/1957 | France | 36/11.5 |
| 1269446 | 9/1959 | France | 36/11.5 |
| 368623 | 2/1939 | Italy | 36/11.5 |
| 412872 | 7/1934 | United Kingdom | 36/11.5 |

*Primary Examiner*—Werner H. Schroeder
*Assistant Examiner*—Diane L. Biefeld
*Attorney, Agent, or Firm*—Townsend and Townsend

[57] ABSTRACT

A sandal, specially suited for use in a wet environment, includes a sole to which one or more x-shaped foot straps are mounted to the front sole portion and a flexible heel basket mounted to the heel sole portion. Each foot strap is made from a continuous length strap which forms first and second loops on the inside and outside edges of the sole. The loops functionally terminate at spaced apart positions along the edge of the sole and are coupled to one another by a ring through which each strap passes. The length of the second, outside strap is adjustable through the use of a buckle to achieve the appropriate tightness of fit. The heel basket includes an adjustable length heel loop strap which fits around the user's ankle. The heel loop strap is fastened to the heel portion of the sole along the inside and outside edges of the sole. The heel loop strap is also connected to the back edge of the sole by an X-support. The X-support includes a pair of straps extending between spaced apart points on the back edge of the sole, crossing over one another and terminating at spaced apart points on the heel loop strap. The X-shaped configuration counteracts the tendency of the user's heel to move laterally within the sandal while walking.

9 Claims, 2 Drawing Sheets

SANDAL

This is a continuation of application Ser. No. 260,626, filed Oct. 21, 1988, now abandoned.

BACKGROUND OF THE INVENTION

Various types of sandal constructions have been made. Some of the sandal constructions are intended to solve specific problems created by certain environments. For example, one involved in activities around the water needs a sandal which provides appropriate support, is comfortable and remains secure even after walking substantial distances. One such sandal is disclosed in my earlier issued U.S. Pat. No. 3,800,444. This type of sandal is quite effective but relies upon a lacing scheme for its attachment. In certain circumstances, such as when the user is standing in water, such a lacing configuration can create problems if one needs to adjust the tightness of fit.

SUMMARY OF THE INVENTION

The present invention is directed to a sandal to which a foot engaging strap is attached to the front portion of the sole. The foot strap includes a first flexible loop extending from the inside edge of the sole and a second flexible loop extending from the outside edge of the sole. The loops each pass through a connector so to join one another creating a generally X-shaped pattern for the foot strap. At least one of the loops, preferably the outside loop, is a variable length loop, preferably continuously adjustable through the use of a slide buckle.

A heel basket is mounted to the heel portion of the sole and includes an adjustable length heel loop sized to encircle the user's lower leg at the ankle. The heel loop is secured to the sole by heel loop supports connected to its lateral sides and at its back by an X-support. The X-support includes a pair of straps, one extending from the inside of the sole to an outside portion of the heel loop and the other extending from the outside edge of the sole to an inside portion of the heel loop strap; this causes the two straps to cross one another and resist lateral movement of the user's heel within the sandal.

In the preferred embodiment the first loop of the X-shaped foot strap is attached to and extends from the sole at a first, forward position and a second, rearward position both adjacent the inside edge of the sole. The second loop of the foot strap is fastened to and extends from a third, forward position and a fourth rearward position of the sole along the outside edge of the sole. The first and second loops of the foot strap are preferably created from a single length of strap. In the preferred embodiment the first loop passes into the interior of the sole at the first, forward position and extends transversely within the sole to emerge from the third, forward position. Likewise, the first loop extends into the sole at the second, rearward position, passes transversely through the interior of the sole and emerges at the fourth, rearward position so that the first and second loops of the footstrap are formed from a continuous piece. This creates a stable, rugged construction which forms a desirable X-shaped foot strap above the arch of the user's foot and surrounds the user's foot with a continuous, unitary strap.

In the preferred embodiment forward and rearward heel loop supports are mounted to each lateral side of the heel loop and are secured at forward and rearward positions along the inside and outside edges of the sole.

The positions of attachment to the sole are closer along the outside edge than the inside edge to help keep the heel properly positioned. Also, the position of attachment of the forward heel loop support at the inside edge is farther forward than the forward heel loop support at the outside edge for added stability.

Other features and advantages of the invention will appear from the following description in which the preferred embodiment has been set forth in detail in conjunction with the accompanying drawings.

DETAILED DESCRIPTION OF THE PREFERRED EMBODIMENT

Figure 1:
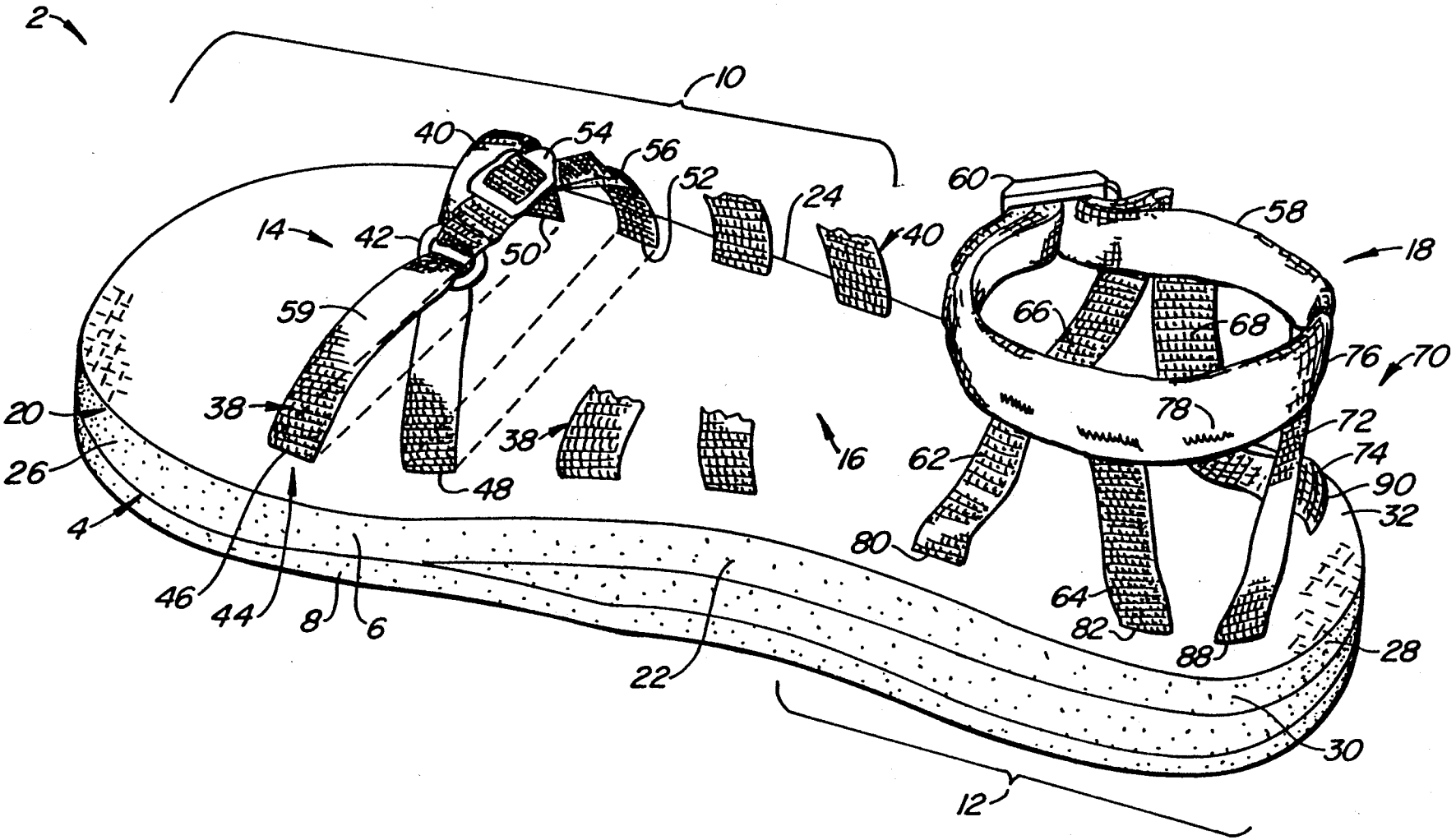
FIG. 1 is a perspective view of a sandal made according to the invention.

Referring now to FIG. 1, a sandal 2 is shown to include a sole 4 which includes an upper sole 6 and a lower sole 8. Lower sole 8 is chosen primarily for wear and traction while upper sole 6 is designed for user comfort. Sole 4 includes a front portion 10 and a heel portion 12. First and second X-shaped foot straps 14, 16 are mounted to front portion 10 and are sized for engaging the instep of a user's foot. A heel basket 18 is mounted to sole 4 at heel portion 12 and is sized capture the user's heel.

Figure 2:
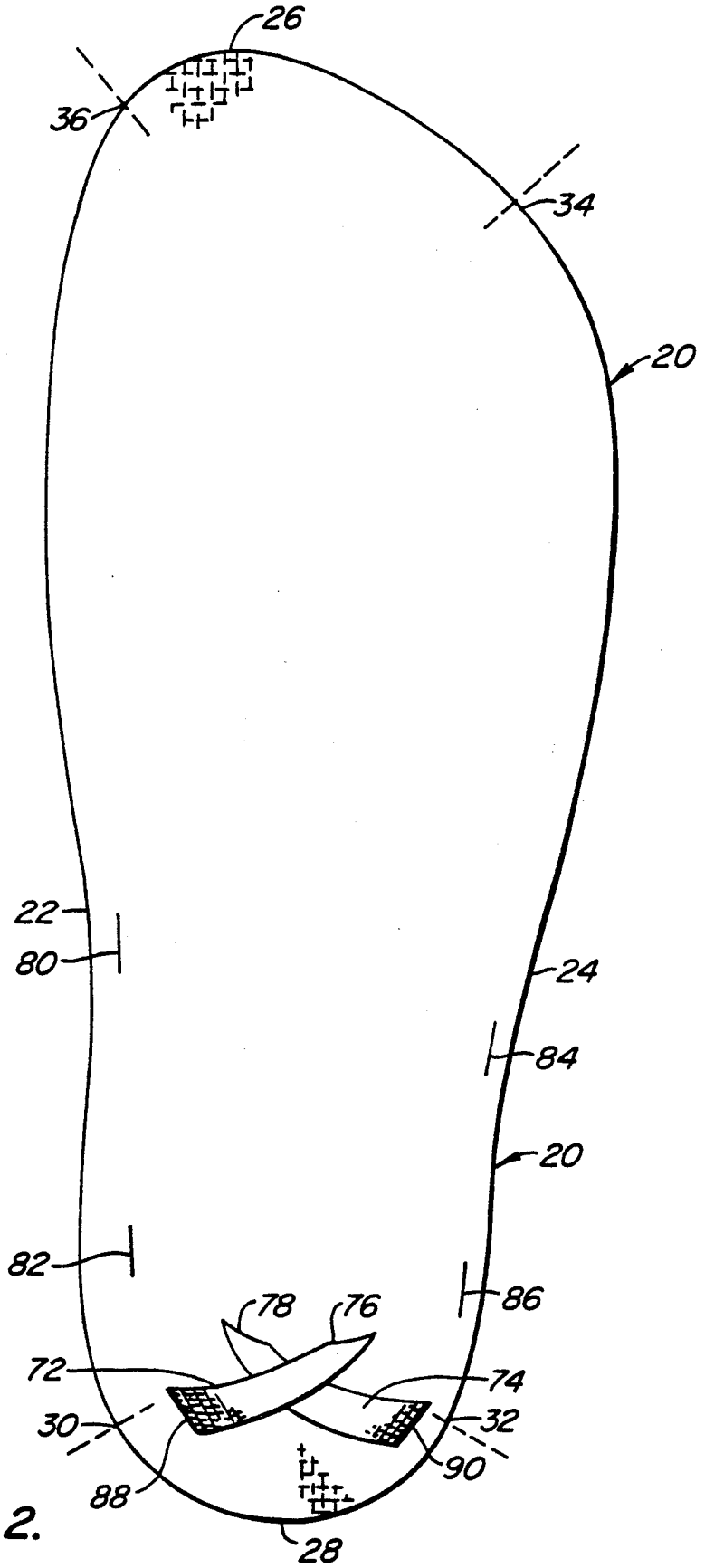
FIG. 2 is a schematic plan view of the sole illustrating the attachment points of the support strap.

Sole 4 includes a circumferential edge 20 which includes an inside edge 22, an outside edge 24, a front edge 26 and a back edge 28. As shown in FIG. 2, edges 22–28 are joined at transition regions 30, 32, 34, 36.

X-shaped foot strap 14 includes a first loop 38, a second loop 40 and a connector ring 42 joining said first and second loops. Loops 38, 40 are preferably made from one-half inch wide nylon webbing for strength, comfort and durability. First loop 38 extends from the upper surface 44 of sole 4 at a first, forward position 46 and a second, rearward position 48, both first and second positions 46, 48 being near inside edge 22. Similarly, second loop 40 extends from a third, forward position 50 and a fourth, rearward position 52. Although first and second loops 38, 40 could be separate members having ends fastened directly to sole 4, in the preferred embodiment the first and second loops constitute a continuous strap as suggested by the dashed lines in FIG. 1. That is, first loop 38 continues from first position 46, through sole 4, preferably between upper sole 6 and lower sole 8, to third position 50 and also continues from second position 48 to fourth position 52. The resulting structure is strong, secure and creates an almost integral construction with the sole 4.

First through fourth positions 46-52 are positioned according to the anatomical construction of the user's foot. Positions 46, 48 are chosen to lie near the ball of the user's foot while positions 50, 52 are placed so to be near the base of the little toe of the foot. First loop 38 is sized to position connector ring 42 in an area of the user's foot which does not have a sharp radius of curvature for increased comfort. The snugness of fit of foot strap 14 is adjusted by the use of a slide buckle 54 which is preferably used with second loop 40, again for maximum comfort according to the shape of the user's instep. As is illustrated in FIG. 1, buckle 54 is on the uppermost leg 56 of second loop 40 for enhanced comfort.

Foot strap 14 is made so that the uppermost leg 59 of first loop 38 continues along a straight line extension of uppermost loop 56 of second loop 40. The lowermost legs of loops 38, 40 also lie in a straight line. This arrangement helps to keep ring 42 flat against the user's foot to enhance the user's comfort.

Second foot strap 16 is constructed in a similar manner to first foot strap 14 and thus will not be described in detail. It is possible to use sandal 2 with only one or both of foot straps 14, 16 but without heel basket 18. However, during energetic activity the use of heel basket 18 as a part of sandal 2 is strongly recommended.

Heel basket 18 includes a heel loop 58, the ends of which are connected by a buckle 60. Heel loop 58 is sized to encircle the user's lower leg at the ankle and is preferably made from a doubled-over length of nylon strap for strength and comfort. Heel loop 58 is secured to sole 4 adjacent inside edge 22 and outside edge 24 by support straps 62, 64, 66 and 68. Support straps 62, 64 extend from positions 80, 82 along inside edge 22 while support straps 66, 68 extend from positions 84, 86 along outside edge 24.

Heel basket 18 also includes an X-support 70. X-support 70 includes an inside heel loop support 72 which extends from sole 4 from a position 88 at the inside transition region 30 upwardly and outwardly to connect to heel loop 58 at a position 76 generally above outside transition region 32. Outside heel loop support 74 extends from sole 4 from a position 90 at outside transition region 32 to a position 78 generally above inside transition region 30. This arrangement results in loop support 72, 74 crossing one another to form an X thus providing lateral support for the user's heel to help counteract the lateral movement of the user's heel within sandal 2.

A user's heel often tends to move towards inside edge 22 while the user is walking or running. To help compensate for this, the positions 80, 82 from which support strap 62, 64 extend are set back away from inside edge 22 a distance greater than the positions 84, 86 from which support strap 66, 68 extend. A similar offset is used for position 88, from which inside heel loop support 72 extends, and position 90, from which outside heel loop support 74 extends. In the preferred embodiment, dependent upon a particular size, for example, men's size nine, positions 80, 82 and 88 are about 1 centimeter from circumferential edge 20 while positions 84, 86 and 90 are about 0.6 centimeter from the circumferential edge. Also, as can be seen clearly from FIG. 2, position 80 is forward of position 84 which also aids proper positioning of the user's foot.

In use the user loosens buckles 54, 60 and places user's foot within sandal 2. Buckles 54, 60 are then tightened to a sufficient snugness according to the activity. If worn in a wet environment, which sometimes can cause foot straps 14, 16 and heel basket 18 to loosen, the user can easily tighten the foot straps and heel basket by simply pulling on the free end of second loops 40 and heel loop 58.

Modification and variation can be made to the disclosed embodiment without departing from the subject of the invention as defined in the following claims. For example instead of X-shaped foot support 14, heel basket 18 incorporating X-support 70 could be used with a different type of instep support at front portion 10 of sole 4. Ring connector 42 has been chosen for convenience, comfort and its pleasing shape. However, other types of connectors, such as a rectangular member having two rectangular openings, could be used as well.

What is claimed is:

1. A sandal comprising:

a sole having an upper surface, a bottom surface, a front portion, a heel portion, and a circumferential edge surrounding the upper and lower surfaces, the circumferential edge including an inside edge and an outside edge on opposite sides of the sole; and a foot strap, sized for engaging the instep portion of a user's foot, attached to the front portion of the sole, the footstrap including:

a first, flexible loop extending from the front portion of said sole at first and second positions along the inside edge;

a second, a flexible loop extending from the front portion of the sole at third and fourth positions along the outside edge;

a connector coupling the first and second loops to one another;

at least one of the first and second loops being an adjustable length loop to permit the snugness of fit to be adjusted; and the second loop being the adjustable-length loop to permit the snugness of fit to be adjusted, the second loop including a buckle for varying the length of the second loop.

2. The sandal of claim 1 wherein:

the circumferential edge includes a back edge at the heel portion connecting the inside and outside edges at inside and outside transition regions; and the heel basket includes:

an upper, adjustable length heel loop sized and positioned to encircle the user's ankle region;

first and second heel loop supports fastening the heel loop to the heel portion of the sole along the inside and outside edges;

third and fourth heel loop supports extending between fifth and sixth positions, along the circumferential edge adjacent the inside and outside transition regions, and seventh and eight positions, along the heel loop; and the seventh position being generally above the sixth position and the eighth position being generally above the fifth position so the third and fourth heel loop supports create an X-support resisting lateral movement of the user's heel within the sandal.

3. A sandal comprising:

a sole having an upper surface, a bottom surface, a front portion, a heel portion, and a circumferential edge surrounding the upper and lower surfaces, the circumferential edge including an inside edge and an outside edge on opposite sides of the sole; and a foot strap, sized for engaging the instep portion of a user's foot, attached to the front portion of the sole, the footstrap including:

a first, flexible loop extending from the front portion of the sole at first and second positions along the inside edge;

a second, flexible loop extending from the front portion of the sole at third and fourth positions along the outside edge;

a connector, said connector comprising a circular ring having a central opening, coupling the first and second loops to one another; and at least one of the first and second loops being an adjustable length loop to permit the snugness of fit to be adjusted.

4. The sandal of claim 3 wherein the first and second heel loop supports extend from the sole at locations first and second distances from the inside and outside edges, the first distance being substantially greater than the second distance to accommodate movement of the user's heel during use.

5. A sandal comprising:

a sole having an upper surface, a bottom surface, a front portion, a heel portion and a circumferential edge surrounding the upper and lower surfaces, the circumferential edge including an inside edge and outside edge on opposite sides of the sole, a front edge and a rear edge;

a foot strap, sized for engaging the instep portion of a user's foot, attached to the front portion of the sole; and a heel basket attached to the heel portion and sized for engaging the heel portion of the user's foot, the heel basket including:

an upper, adjustable length heel loop sized and positioned to encircle the user's ankle region;

first and second heel loop supports fastening the heel loop to the heel portion of the sole along the inside and outside edges;

third and fourth heel loop supports extending between fifth and sixth positions, along the circumferential edge adjacent the inside and outside transition regions, and seven the and eight positions, along the heel loop; and the seventh position being generally above the sixth position and the eighth position being generally above the fifth position so the third and fourth heel loop supports create an X-support resisting lateral movement of the user's heel within the sandal.

6. An article of manufacture to couple a sole to a human, comprising:

a foot strap, coupled to the sole; said foot strap having;

a first loop communicated from an anterior portion of said sole at a first and a second position along a medial edge;

a second loop communicated from said anterior portion of said sole at a third and a fourth position along a lateral edge;

a tension transfer device coupling said first loop to said second loop; and a coupler in at least one of said first and second loops to permit a snugness of fit to be adjusted by adjusting a length of said one of said loops, such that relative movement between the foot and said sole occurring during ambulation causes tension to be substantially equalized at said first, second, third and fourth positions due to tension transfer between said loops.

7. An article of manufacture for coupling a sole to a foot, comprising:

a foot strap, coupled to the sole;

said foot strap having:

a first loop communicated from an anterior portion of said sole at a first and a second position along a medial edge of said sole;

a second loop communicated form said anterior portion of said sole at a third and a fourth position along a lateral edge of said sole;

a tension transfer device coupling said first loop and said second loop to each other, said tension transfer device permitting relative movement between said loops and permitting a point of coupling of each said loop to said tension transfer device to shift in response to ambulation of the foot; and means, in at least one of said first and second loops, for adjusting a length of said one of said first and second loops permitting a snugness of fit between the foot and the sole to be altered.

8. The article of manufacture of claim 7 wherein said relative movement and said shift equalize tension at said first, second, third, and fourth positions.

9. A sandal comprising:

a sole having an upper surface, a bottom surface, a front portion, a heel portion, and a circumferential edge surrounding the upper and lower surfaces, the circumferential edge including an inside edge and an outside edge on opposite sides of the sole; and a foot strap, sized for engaging the instep portion of a user's foot, attached to the front portion of the sole extending between the inside edge and the outside edge of said sole, the foot strap including:

a first, flexible trap having two distal ends, said first strap having one distal end fastened to the front portion of said sole at one of said edges in a first position and having the other distal end fastened to said front portion of said sole at said one of said edges in a second position, said first and second positions being spaced apart at said one edge of said front portion of said sole;

a second, flexible strap extending from the front portion of the sole at least at a third position along the other of said edges of said sole;

a connector, said connector comprising a ring having a central opening with said straps threaded to said connector for transferring tension between said first and second straps across said sole;

said first strap threaded to said connector intermediate said first and second distal ends for permitting said connector to move with respect to said first strap for dynamically conforming to the foot during use of said sandal; and said second strap being an adjustable length strap to permit a snugness of fit to be adjusted relative to the foot.

* * * * *

UNITED STATES PATENT AND TRADEMARK OFFICE

CERTIFICATE OF CORRECTION

PATENT NO. : 5,056,241

DATED : Oct. 15, 1991

INVENTOR(S) : Clifford K. Young

It is certified that error appears in the above-identified patent and that said Letters Patent is hereby corrected as shown below:

Title Page:

In item "76] Inventor:, delete the address of "244 N. Highway 101, Encinitas, Calif. 92024" and substitute therefor, --10565 Sunshine Hill Road, Sonora, Calif. 95370.--.

In column 4, line 14, delete "a flexible" and substitute therefor, --flexible--.

In column 5, line 2 of claim 6, delete "human, comprising:" and substitute therefor, --human foot, comprising:--.

In column 6, line 8, delete "form" and substitute therefor, --from--; and line 35, delete "flexible trap" and substitute therefor, --flexible strap--.

Signed and Sealed this

Thirteenth Day of April, 1993

*Attest:*

STEPHEN G. KUNIN

*Attesting Officer*

*Acting Commissioner of Patents and Trademarks*